United States Patent [19]

Tobler

[11] Patent Number: 5,048,750

[45] Date of Patent: Sep. 17, 1991

[54] DEVICE FOR PRODUCING AND DISPENSING FOAM

[75] Inventor: Viktor Tobler, Ober-Durnten, Switzerland

[73] Assignee: Supermatic Kunststoff AG, Uster, Switzerland

[21] Appl. No.: 333,294

[22] Filed: Apr. 4, 1989

[30] Foreign Application Priority Data

Apr. 5, 1988 [CH] Switzerland ..... 01251/88

[51] Int. Cl.[5] ..... B67D 5/58

[52] U.S. Cl. ..... 222/189; 222/190; 222/211; 222/212; 222/519; 239/343; 239/327

[58] Field of Search ..... 222/189, 190, 211-213, 222/519-521; 239/311, 327, 343, 370, 458, 539

[56] References Cited

U.S. PATENT DOCUMENTS

| | | | |
|---|---|---|---|
| 3,709,437 | 1/1973 | Wright | 222/190 |
| 4,274,594 | 6/1981 | Ito | 222/189 |
| 4,432,496 | 2/1984 | Ito | 222/190 |
| 4,615,467 | 10/1986 | Grogan et al. | 222/190 |
| 4,640,440 | 2/1987 | Ford et al. | 222/190 |
| 4,836,422 | 6/1989 | Rosenberg | 222/190 |

*Primary Examiner*—H. Grant Skaggs

*Attorney, Agent, or Firm*—Michael N. Meller

[57] ABSTRACT

A device for producing and dispensing foam from a foamable liquid stored in a container is arranged on a connecting piece of the container by means of a mounting section. The mounting section is covered by a cap which can be displaced from an open to a closed position. A mixer section is arranged in an axial opening in the mounting section. A pervious mixing element having air and liquid passages is firmly held in the mixer section. The mounting section is constructed as a closure element which makes sealing contact with the end face (16) of the connecting piece and is mounted detachably on the outside wall of the connecting piece. The cap covers the mounting section.

15 Claims, 8 Drawing Sheets

DEVICE FOR PRODUCING AND DISPENSING FOAM

The invention relates to a device for producing and dispensing foam.

BACKGROUND OF THE INVENTION

Devices for dispensing foam produce the foam from a foamable liquid stored in the container using the air also stored in the container. The foam is formed by compressing the container, for example a bottle, during which process the air and liquid are forced out of the container into separate passages, fed to a mixing element for forming foam therein by mixing and conveyed to the outside. This type of foam production avoids the use of environmentally harmful propellant gases.

A conventional device which is on the market has a mounting section which is arranged in the neck of the bottle and in which a conical mixer section is clamped. The mixer section contains essentially coaxial passages for air and liquid leading to a porous mixing element and also a return channel, also coaxial with the passages, for the return of air when the pressure action on the bottle is removed. The mixing element covers the entire coaxial passage system, i.e., both the feed pipes and the return channel. Arranged on the bottle neck is a carrier for a cap which sits on the carrier, can be changed over from an open to a closed position and has a dispensing opening communicating in an open position with a foam outlet arranged above the mixing element.

This known device has various disadvantages. Foam can escape between cap carrier and cap, as a result of which the outside wall of the bottle becomes dirty and difficult to handle. The serviceability of the bottle can only be checked after it is filled so that faulty bottles or devices can only be sorted out at this stage. The secondary air returning upon removing the pressure from the bottle carries liquid back into the bottle via the mixing element, which again converts the air and liquid into foam. This returned foam fills a section of the air space in the bottle and impairs its serviceability. The known device is poorly suited to inverted removal since a so-called wet shot containing incompletely formed foam is always produced at the beginning of the removal process.

SUMMARY OF THE INVENTION

The object of the present invention is to eliminate the disadvantages of the known device.

In accordance with the invention, a device for producing and dispensing foam has a mounting section arranged on a connecting piece of a container for foamable liquids. The mounting section is covered by a cap which is movable between open and closed positions. A mixer section has respective passages for air and liquid directed at a pervious mixing element held in an axial opening in the mounting section. The mounting section is constructed as a closure element which makes sealing contact with the end face of the connecting piece. The mounting section is detachable mounted on the outside wall of the connecting piece and is covered by the cap.

The special design of the mounting section, which can simultaneously act as a cap holder, makes the escape of foam at an undesirable place impossible. If, in addition, the cap and the mounting section are each of single-piece construction, it is possible to test both the perviousness of the mixing element and also the passage for returning secondary air, in particular the tightness of the floating valve, even during assembly.

The special design of the device according to the invention makes it possible to assemble it in a single working step, which is both economically advantageous and technically more reliable.

The return of foam into the liquid container is avoided as a result of the passage for secondary air which is routed outside the mixing element, and the satisfactory operation of the device is thereby ensured even during prolonged continuous use.

If a mixing chamber or chambers is or are arranged upstream of the mixing element, which is advantageous, in particular, in the case of devices used in the upright position, a coarse foam, which can then be further refined in the mixing element, is already produced in the premixing chamber or chambers. In the inverted version, in which no premixing chamber is provided, the liquid feed pipe terminates immediately adjacent to the mixing element.

The occurrence of air leakage is avoided by the provision of a check valve, in particular a floating valve, between the passage for secondary air and the interior chamber of the liquid container.

In addition to a first axially arranged tubular feed pipe for air or liquid, the device has a second coaxially arranged feed pipe for liquid or air. To achieve a particularly advantageous ratio of liquid to air or of air to liquid, the second feed pipe may be arranged in helical or spiral fashion on the circumference of the mounting section and may be bounded by the latter and the inside wall of the cap.

In that the mixing element extends only over the feed pipes or premixing chambers respectively, it is possible to economize on this relatively expensive material. At the same time, it is possible to avoid the re-foaming of returning liquid. In order to avoid the sometimes awkward compression of the container when the container is being used, it may be equipped with an air bellows or a pump for air or for air and liquid.

BRIEF DESCRIPTION OF THE DRAWINGS

The preferred embodiments of the device in accordance with the invention will be described in detail with reference to the drawings, wherein.

DETAILED DESCRIPTION OF THE PREFERRED EMBODIMENTS

Figure 1:
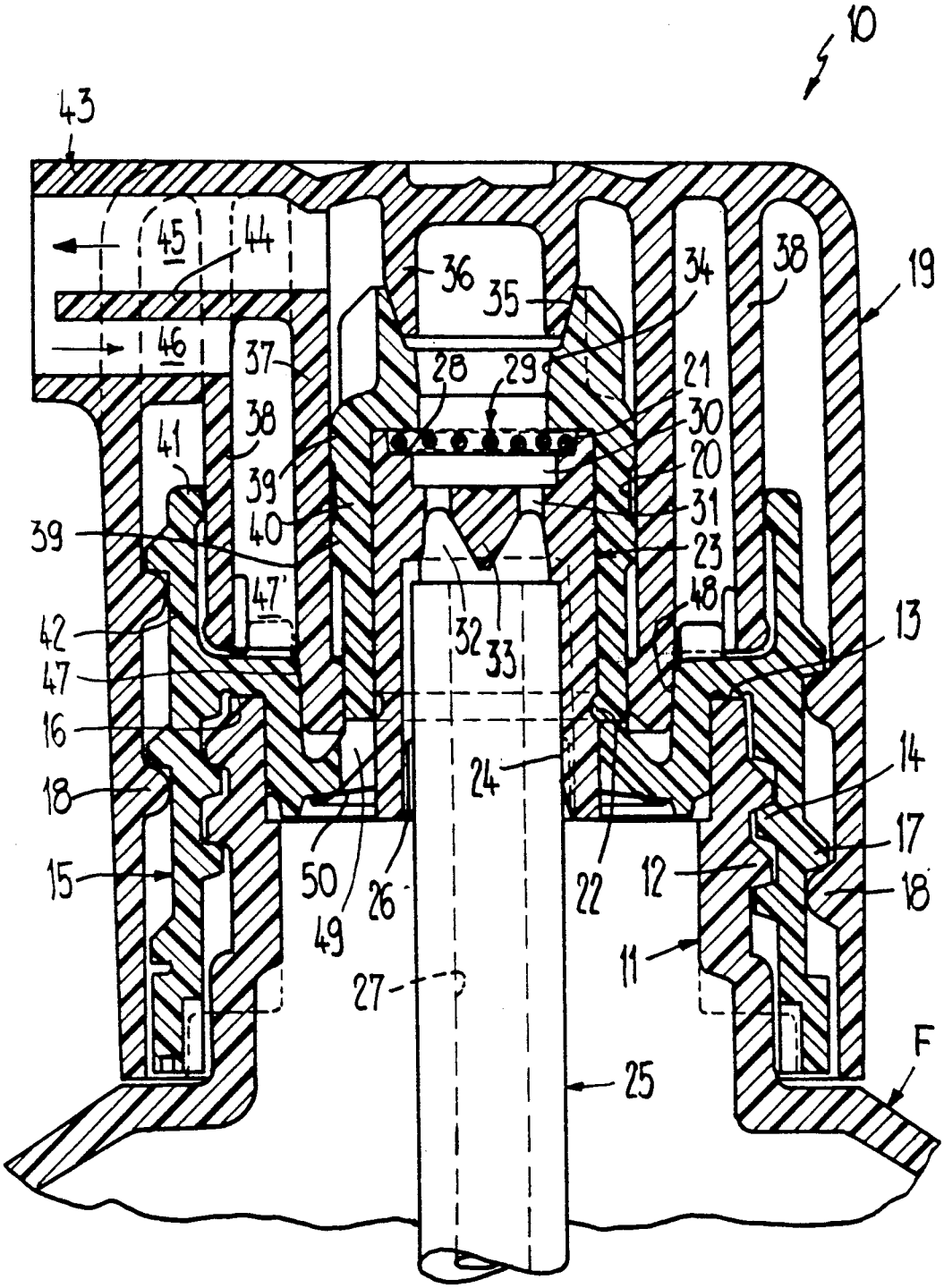
FIG. 1 is an axial section through a first embodiment of the device according to the invention for dispensing foam in a preferable upright position.
Figure 2:
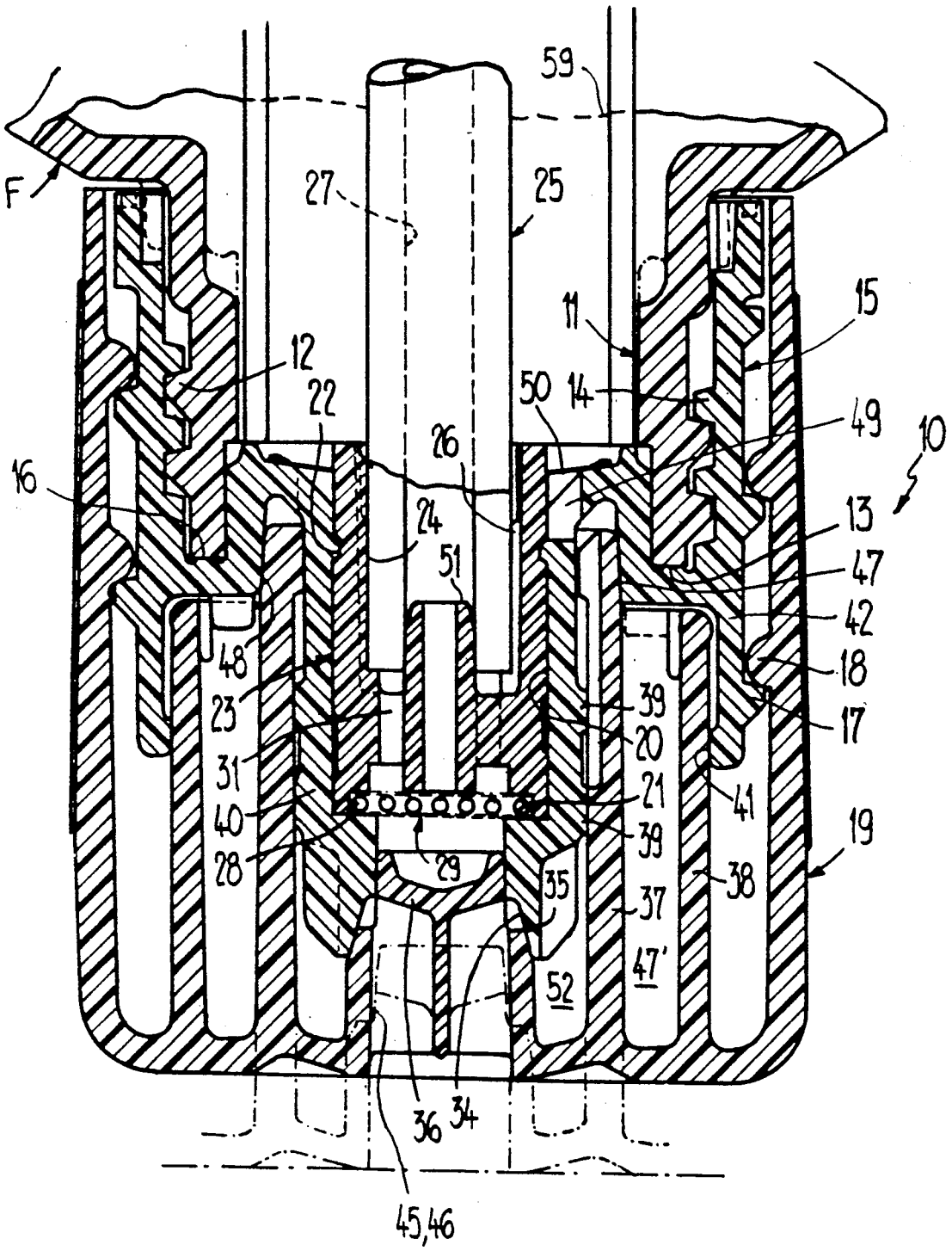
FIG. 2 is an axial section through a second embodiment of the device according to the invention, preferably for inverted dispensation of foam.

In the device as 10 shown in FIGS. 1 and 2, only the neck or connecting piece 11 of a compressible plastic bottle F is standard. Molded onto the outside wall of the connecting piece 11 is an outside thread 12, while the end face 13 of the connecting piece 11 is annular and flat. The inside thread 14 of a mounting section 15 meshes with the outside thread 12. The mounting section 15 also has an annular and flat sealing face 16 which makes sealing contact with the end face 13 when the mounting section 15 is screwed on.

On its outside, the mounting section 15, which is constructed as one piece, has an outside thread 17 with large pitch which engages a matching inside thread 18 of a cap 19, which is also constructed as one piece. In FIGS. 1 and 2, the cap 19 is shown in the closed position and in this position it covers the entire mounting section 15.

The mounting section 15 has an axial opening 20 having a step or shoulder 21. A mixer section 23 is inserted into opening 20 as a force fit by means of a collar-and-annular-groove snap joint 22.

Mixer section 23 has an opening 24 with longitudinal ribs on the inside, into which opening the end of a tube 25 is inserted in a manner such that it is securely held by the crest of the ribs of the opening 24. A ring of passages 26, which ring is coaxial with the continuous tubular passage 27, is consequently produced between the outside of the tube 25, which extends approximately to the bottom of the bottle, and the inside of the opening 24.

At its end face facing away from tube 25, the mixer section 23 has a stepped recess 28 into which a pervious mixing element 29 is inserted. Mixing element 29, which provides for the intimate mixing of liquid and air to form foam, has a sandwich-like structure. It comprises a center section composed of a coarse-mesh sieve netting which is covered on both sides by a fine-mesh sieve netting. As a result, the perviousness or porosity of the mixing element 29, which is an important parameter for foam formation, is exactly reproducible. This is in contrast to mixing elements according to the prior art which are composed as a rule of an open-pore rigid foam-piece of plastic material or ceramic material. In the present case, the mixing element 29 is securely clamped in the recess 28 by the shoulder 21 of the mounting section.

Reference shall now be made solely to the embodiment in FIG. 1. Placed in front of the mixing element 29 in the direction of the tube is a mixing chamber 30 into which a ring of passages 31 debouch. Passages 31 in turn start from a prechamber 32 which forms the end of the opening 24. In the center of the prechamber 32 is a conical deflection body 33 which produces turbulence in the flowing air-liquid mixture. Constructed on the side of the mixing element 29 opposite the mixing chamber 30 is the outlet 34 of the mounting section 15, which outlet is adjoined by a conical sealing surface 35. When the cap 19 is in the closed position shown, the conical outside surface of a plug 36, molded centrally onto the cap on the inside, interacts with sealing surface 35. This sealing position is arranged preferably to follow the mixer section in order to avoid an undesirable escape of liquid.

Molded onto the inside of the cap 19 are two coaxial, essentially hollow-cylindrical extensions, the inner and outer extensions being respectively denoted by 37 and 38. The inner extension 37 has a smooth inside surface which is in contact with collars 39 so as to seal yet be capable of sliding longitudinally. Collars 39 are molded onto the outer lateral surface of the mounting section 15, surrounding the opening 20. The outer lateral surface of the outer extension 38 is also smooth and is in sealing contact with and slidable longitudinally relative to an inwardly directed collar 41 which is molded onto the section 42 of the mounting section 15, which section 42 continues the section which carries the threads 14, 17.

As can be seen from FIG. 1, a connecting piece 43 is constructed on the cap 19, the interior of connecting piece 43 being subdivided into two channels 45 and 46 by partition 44 molded onto the inner extension 37. When the cap 19 is in the open position, channel 45 communicates exclusively with the outlet 34, whereas channel 46 communicates with the jacket chamber 47' between the inner and outer extensions 37 and 38 respectively.

Constructed on the outside of the lower end of extension 37 is a sealing surface 47 which contacts a molded sealing surface 48 on the portion of the mounting section 15 joined to section 40. This sealing surface 47 is preferably arranged in the immediate vicinity of the membrane 50. In this portion there is also a ring of passages 49 whose purpose will be described below.

Finally, it can be seen from FIG. 1 that an annular flexible membrane 50 is molded onto the end, facing away from the mixing element 29, of the mixer section 23 on the outside of the latter. Membrane 50 forms the closing section of a check valve which closes the passages 49 in the event of excess pressure in the bottle. It is attached by means of a hinge and therefore incorrect functioning cannot take place as a result of tilting.

If the cap 19 is now screwed into the open position, the plug 36 separates from the sealing surface 35 and the sealing surfaces 47 and 48 separate from each other. Consequently, on the one hand, the channel 45 communicates with the outlet 34 and, on the other hand, the channel 46 communicates with the passages 49 via the jacket chamber 47'. If the interior chamber of the bottle F is now placed under excess pressure by compression, the membrane 50 closes the passages 49, liquid rises in the tube 25 and air is forced through the passages 26 from the air cushion situated above the liquid level in the bottle. The liquid flow and the air flow impinge on each other in the prechamber 32, are displaced by the deflection body 33 and already become mixed at that point. This mixture (coarse foam) passes through the passages 31 into the mixing chamber 30. From there the mixture is forced through the mixing element 29 and leaves the latter as foam which then emerges from the channel 45 via the outlet 34.

If the compressed bottle F is again released, it returns to its initial shape and underpressure is produced. As a result, the membrane 50 opens the passages 49 and outside air is able to flow back relatively unimpeded through the channel 46, the jacket chamber 47' and the passages 49. In this connection it should be noted that small quantities of foam which may still be present at the outer end of the channel 45 are sucked in from the outer end of the channel 46 and flow back again by the same route into the bottle F, where the foam disintegrates in a short time in contact with the liquid. Although air can also flow back through the channel 45, the air encounters obstacles (mixing element 29, passages 26) on this return path which impede or throttle the flow, with the result that the quantity of air flowing back via channel 45 is significantly smaller than that via channel 46.

It should also be noted that the porosity of the foam produced is finer the more rapidly the bottle F is compressed, since in that case the flow rates increase and the liquid/air mixing becomes more intimate.

As mentioned, the embodiment shown in FIG. 2 is used for the inverted dispensing of foam, i.e., the connecting piece of the bottle F points downwards.

In the mixer section 23 of the device 1 of FIG. 2, the deflection body 33 is replaced by a nipple 51 onto which the tube 25 is drawn.

The prechamber 32 and the mixing chamber 30 are therefore absent, and during use only the foam-forming liquid flows through the passages 31.

In the open position of the cap 19, the plug 36 again separates from the sealing surface 35 and the sealing surfaces 47 and 48 separate from each other. Consequently, the channel 45/46, which is combined in this case, communicates, on the one hand, with the outlet 34 and, on the other hand, with the passage 49.

If the internal chamber of the bottle F with the connecting piece 11 pointing downward is now placed under excess pressure by compression, the membrane 50 closes the passages 49, air is forcibly fed through the passages 26 and 31 to the mixing element 29, and after air and liquid have been mixed in the mixing element, the foam produced emerges from the channel 45/46 via the outlet 34.

If the compressed bottle is released again, it returns to its initial shape and an underpressure is produced. As a result, the membrane 50 opens the passages 49 and outside air can flow back relatively unimpeded through the channel 45/46, an adjacent jacket chamber 52 and the passages 49. The air flowing back into the bottle through the open membrane 50 now enters a guide tube 59 which surrounds the tube 256 and through which it enters the air space (not shown) of the bottle. The guide tube 59 has internal ribs with which it is firmly held in a centered position on the tube 25. In other respects, this process takes place as described in more detail in conjunction with FIG. 1.

Figure 3:
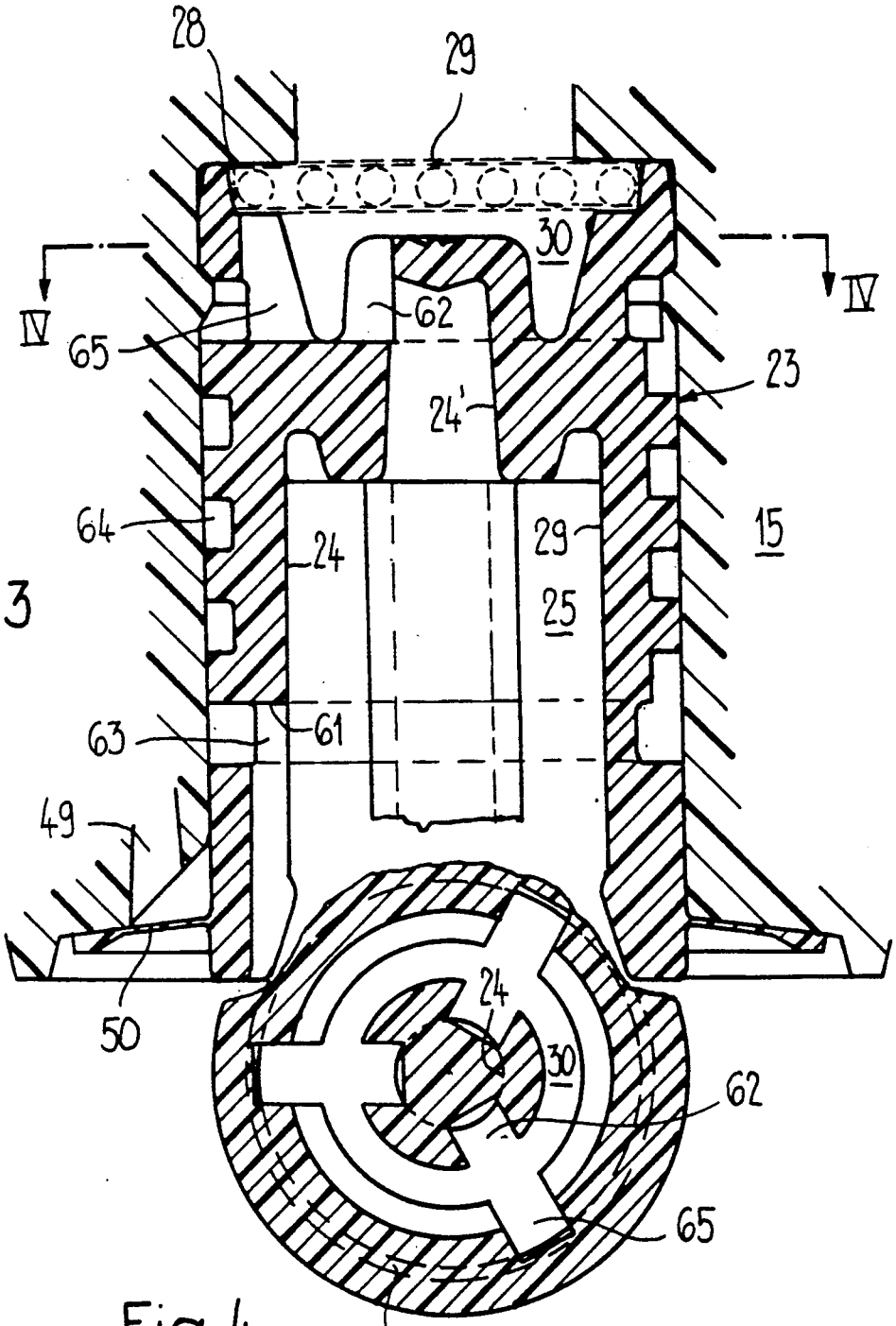
FIG. 3 is an axial section through a mixer section of a third embodiment of the device according to the invention for preferably dispensing foam in the upright position.
Figure 4:
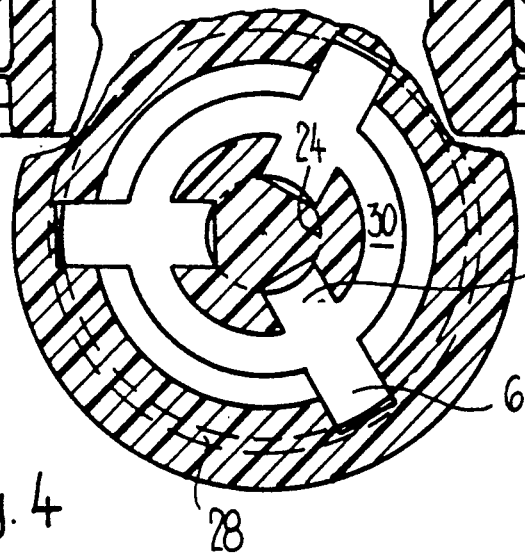
FIG. 4 is a sectional view of the mixer section taken along line IV—IV in FIG. 3.

The mixer section shown in FIGS. 3 and 4 is suitable preferably for foam formation and dispensing from a bottle in the upright position. Since it is partly analogous in construction to the embodiment in FIG. 1, parts already described in FIG. 1 are provided with the same reference numerals used there.

Opening 24 in this case is provided only with inwardly projecting ribs down to 61 and is in other respects smooth-walled. Tube 25 is held firmly in opening 24 and debouches into the stepped narrowed extension 24' thereof. The extension 24' communicates with the mixing chamber 30 through radially arranged openings.

The passages 26 end at 61. At this point, the mixer section 23 has one or more radial perforation(s) 63 in the vicinity of the passages 26. Adjacent thereto on the outside wall of the mixer section 23, helical feed pipes 64 are present which debouch via radial passages 65 into the mixing chamber 30.

The helical feed pipes 64 make it possible to improve the mixing process and to keep the mixing ratio constant.

Figure 5:
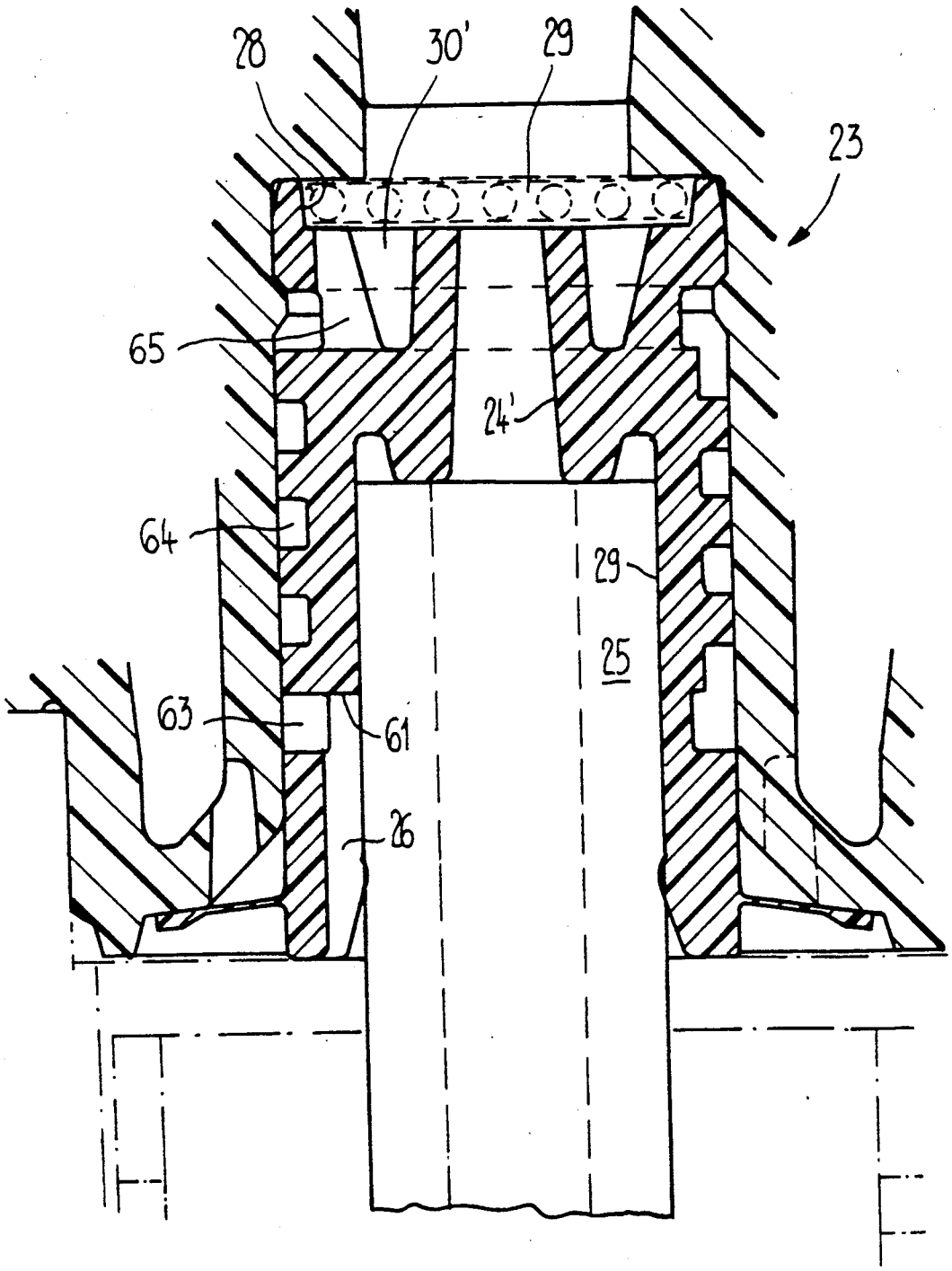
FIG. 5 is an axial section through a further embodiment of the mixer section, preferably for the inverted dispensation of foam.

The mixer section 23 depicted in FIG. 5 is suitable preferably for foam formation and dispensing in the inverted position. The parts described in conjunction with FIG. 1 or FIG. 3 are denoted with the same reference numerals. In this case, the stepped and constricted extension 24' of the opening 24 ends immediately adjacent to the mixing element 29. The helical feed pipes 64 end in prechambers 30' placed in front of the mixing element 29 in the flow direction via radial passages 65. From this arrangement it follows that in this case the mixing first takes place in the mixing element 29. In this case, too, an improved mixing ratio is achieved by the helical shape of one feed pipe.

Figure 6:
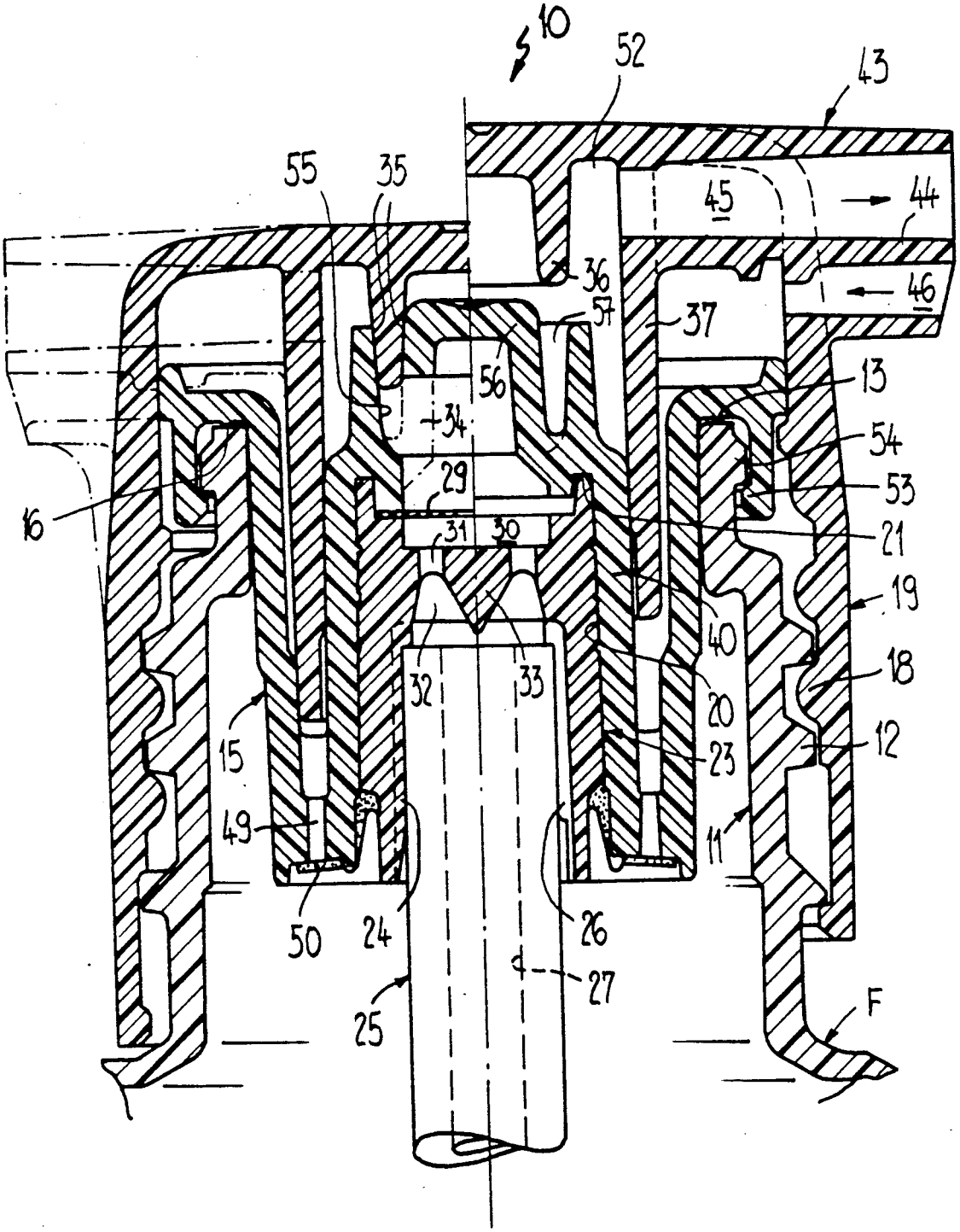
FIG. 6 is an axial section through a further embodiment which is particularly suitable for dispensing foam in the upright position, on the left in the closed position and on the right in the open position.

The embodiment shown in FIG. 6 roughly corresponds to that in FIG. 1 but is simplified in various respects.

It is seen that the mounting section 15 is not screwed onto the outside thread 12 on the connecting piece 11 as in FIG. 1 but rather has an annular, inwardly directed and molded-on protrusion 53 which engages behind an outwardly projecting protrusion 54. The sealing surface 16 of the mounting section 15 has in this case the shape of an annular lip and is in full and tight contact with the end face 13 of the connecting piece 11.

In this case it is the cap 19 which is screwed onto the outside thread 12 of the connecting piece 11 by means of its inside thread 18.

In this case the outlet 34 from the mounting section 15 does not extend axially as in FIG. 1, but radially, with the result that the foam emerging from the mixing element 29 is first thrown against a jacket-shaped wall 55 before it finds its way past the plug 36 to the dispensing channel 45. The outlet 34 is in this case constructed in a coaxial coupler 56 molded onto the mounting section 15. As can be seen in FIG. 6, in the closed position the plug 36 penetrates into the gap 57 between the outside wall of the cupola 57 and the jacket wall 55 and consequently forms a tight closure.

In relation to the mode of operation of the embodiment of FIG. 6, reference is made to the preceding description of the mode of operation of the embodiment shown in FIG. 1. Notable in the case of the embodiment of FIG. 6 is its simpler construction, which applies both to the mounting section 15 and also to the cap 19. Thus, the mounting section 15 does not have an inside thread and the need for the extension 38 disappears in the case of cap 19.

If the embodiments of FIGS. 1 and 2 are compared with each other, it is found that the design of the mounting section 15 is virtually identical in these two embodiments. The same applies to the embodiment of FIG. 7 when compared with that of FIG. 6.

Figure 7:
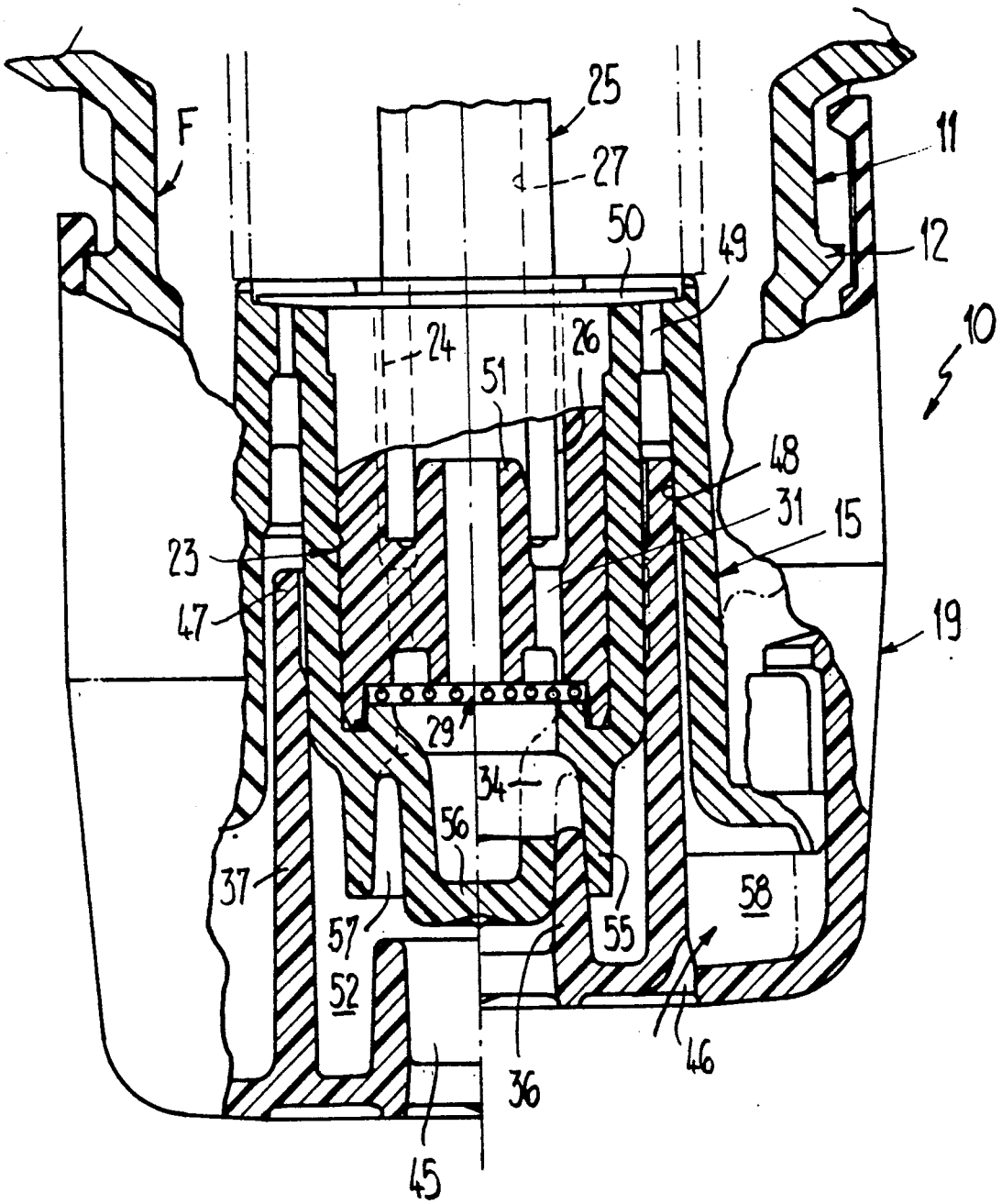
FIG. 7 is an axial section through one more embodiment which is conceived in particular for inverted dispensing, on the left in the open position and on the right in the closed position.

In the embodiment of FIG. 7, only the mixer section 23 and the cap 19 screwed onto the outside thread of the connecting piece 11 are shaped differently compared with the embodiment of FIG. 6.

As can be seen from FIG. 7, the foam leaving the mixing element 29 again flows through the radial outlet 34 into the cupola 56, impinges on the jacket wall 55 and then leaves the cap 19 through the central outlet channel 45. On its way out, the foam is compressed and expanded several times and this contributes to an improvement in foam quality. Since the liquid/air mixing process in the mixer section 23 and in the mixing element 29 is still not particularly intensive when pressure is first exerted on the bottle F, a so-called "wet shot" is produced, as already mentioned, i.e., a liquid jet mixed with only a little air. Due to the wall 55, however, this liquid does not escape or hardly flows out via the channel 45, but collects in the annular space 52 between the outside of plug 36 and the inside wall of extension 37 molded onto the cap 19. Only after that does foam containing fine bubbles pass through the channel.

When the inverted removal of foam is complete, the bottle F is again uprighted, upon which its initial shape returns. At the same time, an underpressure is produced in the bottle. If the cap is still open, outside air now flows through the opening 46, which is constructed through the side of the outlet channel 45, (bottom right in FIG. 7) into the annular space surrounding the continuation 37 and from there through the gap between the outside of the continuation 37 and the lifted sealing surface 47 (on the left in FIG. 7) and through the passages 49 now released by the flat membrane 50, back into the bottle F until pressure balance is again restored.

Figure 8:
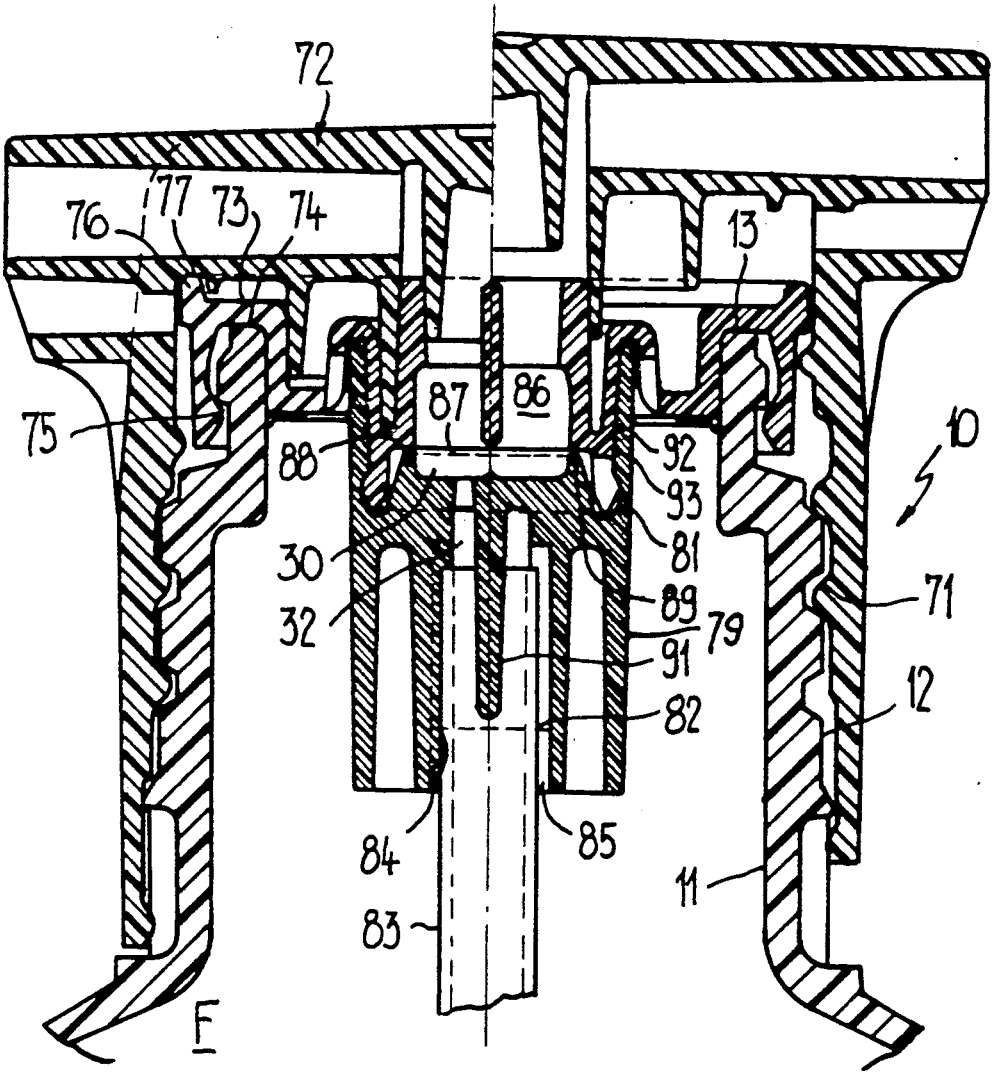
FIG. 8 is an axial section through a further embodiment, preferably for dispensing foam in the upright position, on the left in the closed position and on the right in the open position.

As in FIGS. 1 and 2, the neck or connecting piece 11 of a compressible plastic bottle F in the device 10 is shown in FIG. 8. An outside thread 12 is molded onto the outside wall of the connecting piece 11, while the end face 13 of the connecting piece 11 is annular and flat. The inside thread 71 of a cap 72 engages the outside thread 12. In addition to resting on the outside thread 12, the cap 72 rests on a mounting section 73. The mounting section 73 is firmly held on the connecting piece 11 by means of a snap closure 75 of known type. It also has an annular and flat sealing surface 74 which forms a sealing contact with the end face 13. This mounting section 73 has a lower overall height, which permits greater dimensional accuracy during manufacture.

The mounting section 73, which is constructed as one piece, has a shoulder 76 on its upper circumference, which shoulder 76 engages in a corresponding recess 77 when cap 72 is in the closed position. The cap 72, which is shown on the left in the closed position and on the right in the open position, covers the mounting section 73.

On the bottle side of the mounting section 73, a mixer section 79 is firmly held coaxially by means of a snap closure 81, the outside wall of the mounting section 73 and the inside wall of the mixer section, which walls form the sealing surfaces 92, 93 of conical construction. This produces an improved sealing characteristic.

The mixer section 79 has an opening 82 which has longitudinal ribs on the inside and into which the end of a tube 83 is inserted in a manner such that it is firmly held by the ribs 84 in the opening 82. A ring of passages 85 is consequently produced between the outside of the tube 83, which extends roughly to the bottom of the bottle, and the inside of the opening 82.

The mounting section 73 has an opening 86 communicating with the opening 82 in the mixer section 79 and coaxial with the latter and, at the end surface facing toward the mixer section 79, a stepped recess 88 into which a mixing element 87 is inserted. Mixing element 87 is firmly held by a clamping lip 89 of the mixer section.

The mixing element 87 corresponds to the one which was shown and described in the preceding figures. Mixing chamber 30 and prechamber 32 were also shown and described therein.

In contrast to the preceding embodiments, an elongate conical deflection body 91 is provided in the embodiment of FIG. 8 which projects into the tube 83, thereby reducing the free cross section of the tube. During operation, this produces an acceleration of the liquid flow before being mixed with air, thereby improving the foam formation. This advantage is significant in the case of an already partially emptied bottle and, in particular, in the case of a largely emptied bottle.

The design and function of the cap 72 essentially correspond to those of the cap in FIG. 1. Differences exist in this case to the extent which is required by the design of the mounting section, which is in this case shorter and simpler.

Figure 9:
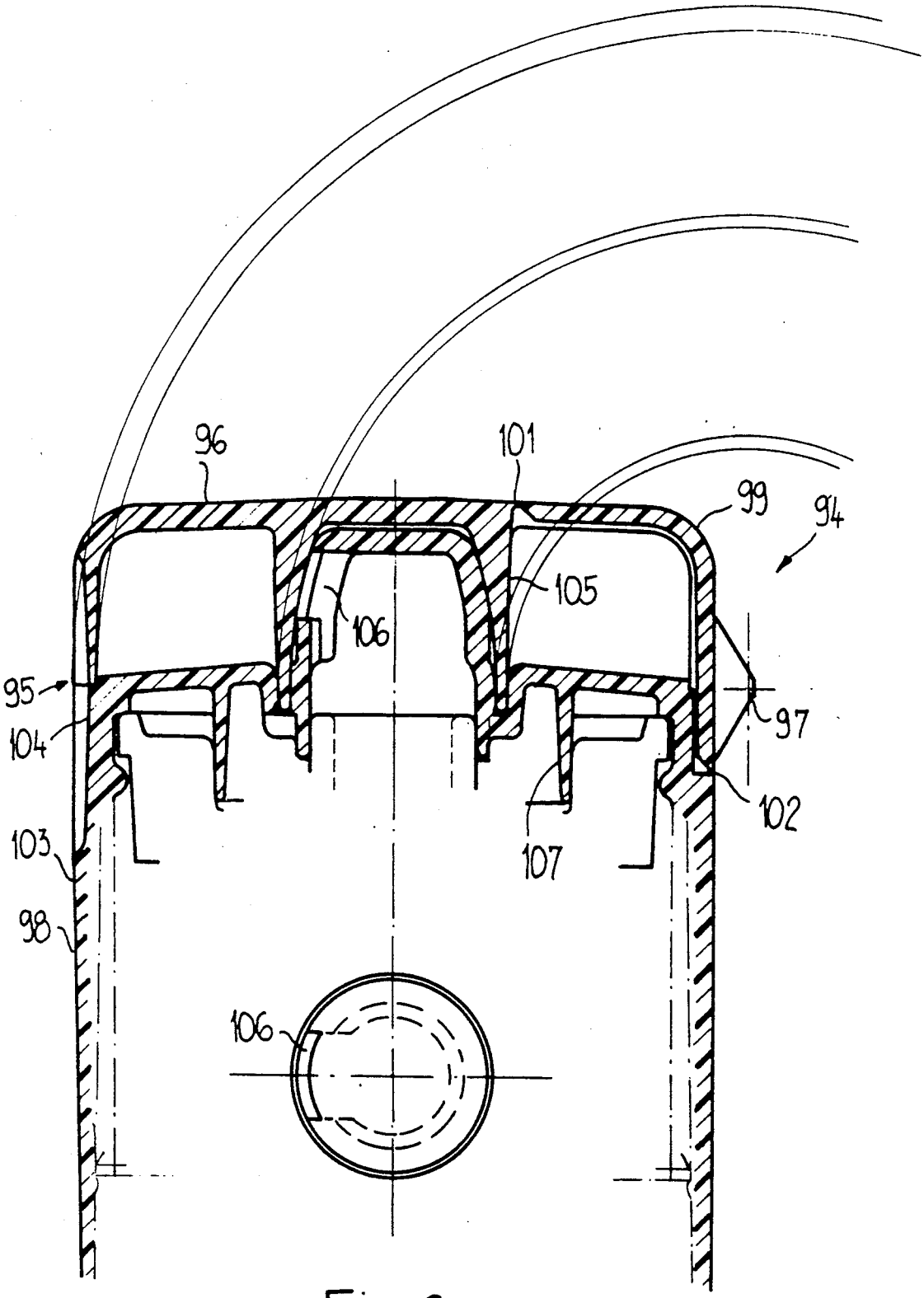
FIG. 9 is an axial section through a further embodiment, preferably for dispensing foam in the upright position.

Essentially only the cap in the closed position of the device 94 is shown in FIG. 9. The top section 96 of the cap 95 is pivoted so as to swing up by means of two hinges 97 (only one of which is shown) on the lower section 98 of the cap 95. Arranged between the two hinges 97 is a spring tongue 99 which is joined by tapered regions 101, 102 in an articulated manner with the top section 96 and the lower section 98 of the cap 95. Spring tongue 99 acts as a closure spring. A recess 104 is provided on the side of the cap sheath 103 opposite the hinge 97 and the tongue 99.

To transfer the cap 95 from the closed position shown to the open position, the top section 96 is swung upwards in rocker-arm fashion by upwardly directed finger pressure inside the recess 104. In this process, the cap sheath 103 and the inner sealing cylinder 105 of the cap each describe a path indicated by circular arcs. After passing a dead point, the opening process is terminated by the action of the spring tongue.

In the open position of the cap 95, a lateral exit opening 106 (in a mounting section 107 not shown in further detail) is released. Foam production and dispensing then take place as already described above.

Depending on whether the connecting piece of the container is designed with, for example, a fairly large or a fairly small protrusion on its outer circumference, the device according to the invention may form part of a throw-away or a refillable device for producing and dispensing foam.

A plastic container which can be deformed elastically by bending and which has high resilience is preferably used as the container for the foamable liquid.

In particular, bottles made of polypropylene, which does not exhibit stress whitening, are suitable for this purpose. Instead of compressing the container, an air bellows or an air pump may provide the necessary excess pressure in the bottle. A liquid pump may be provided on the container for topping up the liquid.

What is claimed is:

1. A device attachment to a container for storing foamable liquids for producing and dispensing foam, comprising a mounting section which is arranged on a connecting piece of the container, a cap which covers the mounting section and is movable between open and closed positions, said cap having an opening and first and second passages which communicate with the external environment by way of said opening, and said mounting section having an axial passage which communicates with said first passage in said cap and a non-axial passage which communicates with said second passage in said cap when said cap is in said open position, a pervious planer mixing element firmly held in an axial opening in a mixing section, said mixing section having an air passage and a liquid passage each directed at the planar mixing element, wherein the mounting section is constructed as a closure element which makes sealing contact at an end face of the connecting piece and is detachably mounted on the outside wall of the connecting piece; a check valve is arranged between the non-axial passage in the mounting section and the internal chamber of the container, said check valve being open when said container is de-compressed to allow said opening of said cap to communicate with said internal chamber of the container by way of said second passage in said cap and said non-axial passage in said mounting section.

2. The device as claimed in claim 1, wherein the mounting section and the cap are each of single-piece construction.

3. The device as claimed in claim 1, wherein the mounting section additionally makes sealing contact with the inside wall of an opening in the connecting piece.

4. The device as claimed in claim 1, wherein the cap is screwed onto the mounting section.

5. The device as claimed in claim 1, wherein the mounting section is firmly held by means of a latching joint in the connecting piece while the cap is screwed onto an outside thread present on the outside of the connecting piece.

6. The device as claimed in claim 1, wherein a closing section of the check valve is constructed as a single piece with the mixing section.

7. The device as claimed in claim 1, wherein the mixing element is securely clamped by the mounting section on the mixing section.

8. The device as claimed in claim 7, wherein the mixing element comprises a coarse-mesh center section sandwiched between two fine-mesh fabrics.

9. The device as claimed in claim 1, wherein the mixing section contains two premixing chambers upstream in the flow direction of the mixing element, a reduction in cross section being present between two premixing chambers.

10. The device as claimed in claim 9, wherein the mixing section has a cylindrical structure and the mixing element substantially covers only the air and liquid passages.

11. The device as claimed in claim 9, wherein the mixing section has a cylindrical structure and the mixing element substantially covers only the premixing chamber.

12. The device as claimed in claim 1, further comprising a first tubular feed pipe arranged in the axial opening of the mixing section and a second feed pipe helically constructed on the outside wall of the mixing section and bounded by the mounting section, said first and second feed pipes being air and liquid respectively and directed at the mixing element.

13. The device as claimed in claim 1, wherein, in the closed position, the cap is in close contact with an outlet opening of the mounting section.

14. The device as claimed in claim 1, wherein an annular chamber is arranged in the cap in front of an outlet channel and serves as a collecting space for liquid which is not yet fully foamed.

15. The device as claimed in claim 1, wherein the mounting section is firmly held by means of a snap joint int he connecting piece while the cap is screwed onto an outside thread present on the outside of the connecting piece.

* * * * *